United States Patent [19]

Vogl

[11] Patent Number: 4,573,753

[45] Date of Patent: Mar. 4, 1986

[54] CONNECTOR ADAPTER FOR PRINTED CIRCUIT BOARD OF COMPUTER

[76] Inventor: Allen W. Vogl, 642 Tulane Ave., Melbourne, Fla. 32901

[21] Appl. No.: 667,754

[22] Filed: Nov. 2, 1984

[51] Int. Cl.[4] ..... H01R 23/68

[52] U.S. Cl. ..... 339/17 LM; 29/857

[58] Field of Search ..... 339/17 R, 17 L, 17 LC, 339/17 LM, 17 M, 125 R, 126 R, 132 R, 132 B; 361/390–395, 399, 413, 415; 29/857

[56] References Cited

U.S. PATENT DOCUMENTS

| | | | |
|---|---|---|---|
| 2,777,893 | 1/1957 | De Rosso | 361/399 |
| 2,885,603 | 5/1959 | Rose | 339/17 LM |
| 2,910,627 | 10/1959 | Matteson et al. | 339/17 M |
| 2,945,989 | 7/1960 | Vogel et al. | 339/17 LM |
| 3,131,330 | 4/1964 | Allen | 361/391 |
| 3,160,456 | 12/1964 | O'Keefe et al. | 339/92 |
| 3,551,874 | 12/1970 | Volinskie | 339/17 |
| 3,569,788 | 3/1971 | Niblack | 361/391 |
| 3,850,492 | 11/1974 | Moore | 339/18 R |
| 3,963,300 | 6/1976 | Patton et al. | 339/156 R |
| 3,990,763 | 11/1976 | Kress | 339/155 R |
| 4,082,421 | 4/1978 | Auracher et al. | 350/96.22 |

OTHER PUBLICATIONS

Add-on Products for IBM PC/XT.

Expanding Microcomputing–STB Systems, Incorporated.

Expanding Your PC or XT–Vista Company, Inc.

Display and Printer Adapter, pp. 10 and 11.

The Time Spectrum, by Persyst.

Monte Carlo Card, Microcomputer Business Industries Corporation.

*Primary Examiner*—Neil Abrams

*Attorney, Agent, or Firm*—Antonelli, Terry & Wands

[57] ABSTRACT

A connector adapter is disclosed for making a plurality of electrical connections to a printed circuit board of a personal computer from peripheral equipment. The adapter comprises a plurality of multiple pin connectors in a housing. The housing is releasably mechanically connected to a mounting bracket which, in turn, is releasably mechanically connected to the printed circuit board. The mounting bracket includes a slot formed therein which receives ribbon cables or a connector printed circuit board assembly for connecting each of the plurality of connectors of the adapter to the printed circuit board. Four twenty-five pin D-shell connectors can be provided in a housing of the adapter which occupies the space of only one expansion slot of a personal computer with the housing providing full RFI shielding. No modifications to the computer cabinet are required to accept the connector adapter.

14 Claims, 7 Drawing Figures

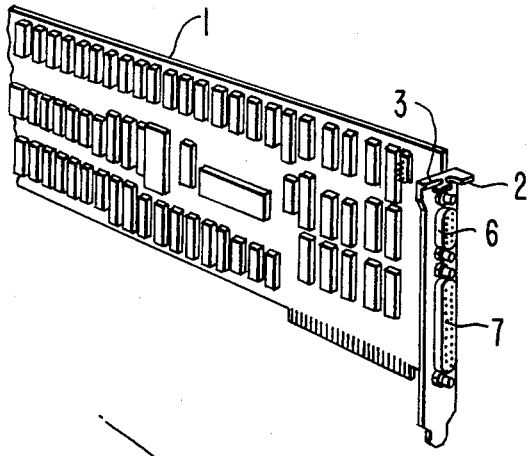
FIG. 1.
(PRIOR ART)
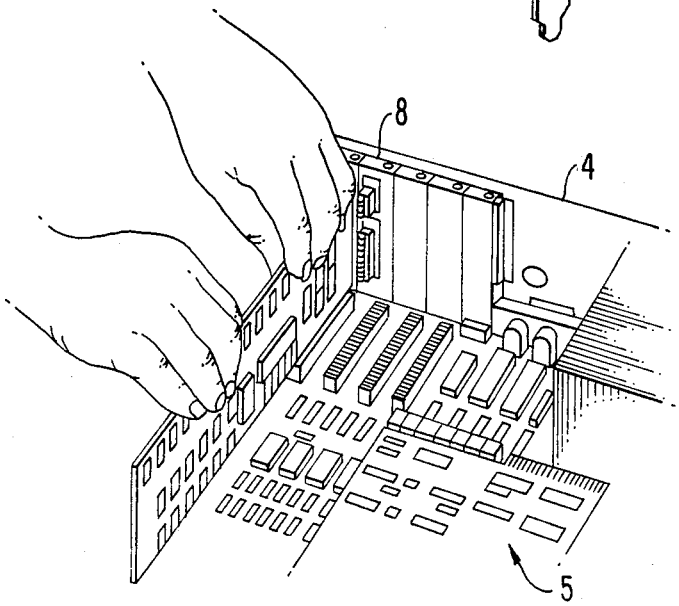
FIG. 2.
(PRIOR ART)
FIG. 3.
(PRIOR ART)
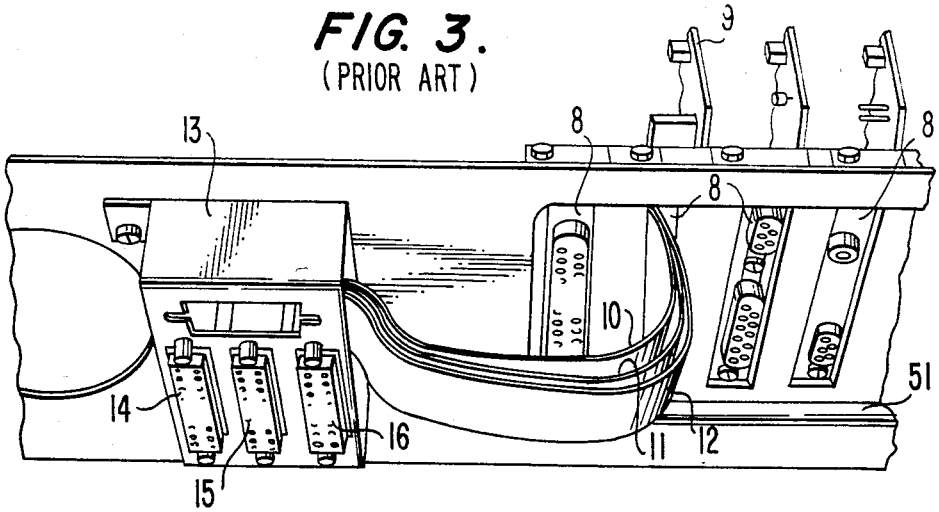

CONNECTOR ADAPTER FOR PRINTED CIRCUIT BOARD OF COMPUTER

BACKGROUND AND SUMMARY OF THE INVENTION

The present invention relates to a connector adapter for a computer and, more particularly, to a connector adapter for use with a personal computer which permits a circuit board of the computer to be coupled to a number of peripherals external to the computer.

A typical printed circuit board that IBM supplies for a personal computer is identified by the reference numeral 1 in FIG. 1 of the drawings. The board 1 is provided with a retaining bracket 2 at one end thereof. The bracket 2 is formed with a retainer screw slot 3 for connecting the board to the rear panel 4 of a personal computer 5 in the manner illustrated in FIG. 2. The bracket 2 carries a nine pin video connector 6 and a twenty-five pin printer connector 7 which extend through a single expansion slot 8 in the rear panel 4 of the computer for connection to the appropriate peripherals external to the computer. The printed circuit board 1 is inserted into the personal computer by holding the top of the board firmly and pressing it into the expansion slot as shown in FIG. 2.

Peripheral equipment and custom houses offer replacements for the printed circuit boards or cards in personal computers such as the IBM equipment illustrated in FIGS. 1 and 2. These replacement cards may be tailored for add-ons. One example of a replacement card and connector scheme therefor supplied by STB Systems, Inc. is depicted in FIG. 3. This arrangement is typical of a number of expansion board manufacturers and includes a multi-function printed circuit board 9 which replaces the normal IBM card 1 shown in FIGS. 1 and 2. No D-shell connectors are located directly on the board 9. Ribbon conductors cables from individual header connectors on the board 9 run through a slot in the mounting bracket and through the expansion slot in the rear panel of the computer to an external bracket 13 located laterally of the expansion slots in the rear panel. Connections are made to external peripherals at the D-shell connectors 14, 15 and 16 of the bracket 13. One disadvantage with this known arrangement is that the FCC Class B certification of the personal computer may be defeated due to unshielded cables located outside the computer cabinet.

Some manufacturers provide one twenty-five pin D-shell connector located on the board and leave space for the remaining ribbon conductor cables to exit the cabinet to be mounted elsewhere. However, this type of connector scheme also suffers from the aforementioned disadvantage because of the unshielded cables located outside the cabinet. Ribbon conductor cables extending within the cabinet can also interfere with connectors on other printed circuit boards.

Thus, there is a need for an improved connector adapter for making a plurality of electrical connections to a printed circuit board of a personal computer without risking loss of the FCC Class B certification of the personal computer and without interfering with adjacent expansion slots in the rear panel of the computer cabinet or with connectors on other circuit boards.

Thus, an object of the invention is to provide a connector adapter for making a plurality of electrical connections to a printed circuit board of a personal computer which provides full RFI shielding of the conductors extending from the multiple pin electrical connectors of the adapter to the printed circuit board.

A further object of the invention is to provide a connector adapter for making a plurality of electrical connections to a printed circuit board of a personal computer without interfering with adjacent expansion slots in the rear panel of the computer cabinet or with connectors on other circuit boards while at the same time providing a connector adapter which is configured to receive up to four multiple pin electrical connectors from external peripherals.

These and other objects of the invention are attained by providing a connector adapter for making a plurality of electrical connections to a printed circuit board of a personal computer, the connector adapter comprising means for receiving a plurality of multiple pin electrical connectors, means for electrically connecting the plurality of multiple pin connectors to the printed circuit board, a mounting bracket for releasably mechanically connecting the adapter directly to the printed circuit board and means for releasably mechanically connecting the mounting bracket on the adapter.

The means for receiving a plurality of multiple pin electrical connectors in a preferred embodiment of the invention can receive at least four multiple pin connectors with a first pair of the connectors arranged in side by side relationship and the second pair arranged in side by side relationship above the first pair so that the width of the adapter occupies the space of only one expansion slot in a rear panel of the personal computer.

In the disclosed embodiment, the mounting bracket includes means for releasably mechanically connecting the bracket to the rear panel of the personal computer. A slot is also formed in the mounting bracket for receiving the means for electrically connecting the plurality of multiple pin electrical connectors to the printed circuit board.

The means for releasably mechanically connecting the mounting bracket to the adapter includes a pair of fasteners located adjacent respective ends of the slot formed in the mounting bracket. The fasteners extend through and retain mounting tabs on the connector adapter housing which extend through the slot in the mounting bracket to flanged portions of the bracket at each end of the slot which carry the respective fasteners. The fasteners are offset with respect to one another for easy access.

The means for electrically connecting the plurality of multiple pin electrical connectors to the printed circuit board includes a plurality of ribbon conductor cables connecting respective ones of the plurality of connectors to individual connectors of the printed circuit board. The ribbon conductor cables extend from the multiple pin electrical connectors through the slot of the mounting bracket of the adapter to the respective connectors on the printed circuit board. These ribbon conductor cables are fully RFI shielded by the connector adapter housing which extends to position closely adjacent the slot in the computer cabinet. In another form of the invention a connector printed circuit board assembly is used in place of the ribbon conductor cables for connecting each of the plurality of multiple pin electrical connectors to a single multi-function board connector on the printed circuit board of the computer.

These and other objects, features and advantages of the present invention will become more apparent from the following description when taken in connection with the accompanying drawings which show, for purposes of illustration only, one embodiment in accordance with the invention.

BRIEF DESCRIPTION OF THE DRAWINGS

FIG. 1 is a perspective view of a typical printed circuit board that IBM supplies having a nine pin video connector and a twenty-five pin printer connector on a bracket at one end of the card;

FIG. 2 is a perspective view of the manner of installation of the printed circuit board of FIG. 1 into an expansion slot of the rear panel of the personal computer cabinet;

FIG. 3 is a perspective view of a prior art connector scheme wherein a connector adapter is mounted on the rear panel of a personal computer laterally of the expansion slots therein with ribbon conductor cables extending through the expansion slot and a slot in the bracket at the end of the printed circuit board to multiple pin connectors on the board;

DESCRIPTION OF THE PREFERRED EMBODIMENT

Figure 4:
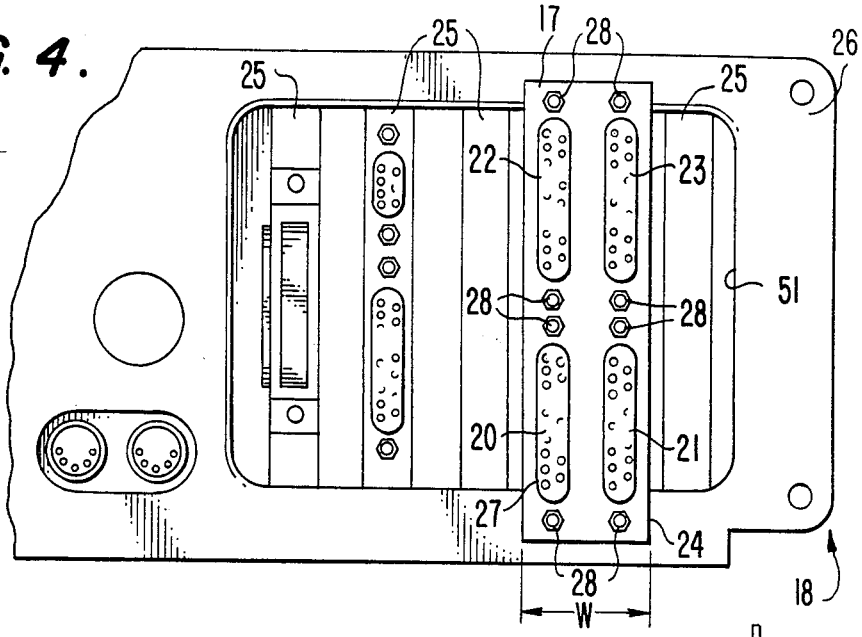
FIG. 4 is a side view of the rear panel of the cabinet of a personal computer provided with a connector adapter according to the invention which is located in one expansion slot of the rear panel.

Referring now to the drawings, and particularly with reference to FIGS. 4–7, a connector adapter 17 of the invention is shown in use on a personal computer 18 for making a plurality of electrical connections to a printed circuit board 19. The printed circuit board 19 is a multi-function card, such as the board 9 in FIG. 3, which requires more or larger connectors than the conventional arrangement described above having only one nine pin connector 6 and one twenty-five pin connector 7. For example, the board 19 may require two or more twenty-five pin connectors. The connector adapter 17 of the invention is used in place of the external bracket 13 and connector scheme therefor as shown in FIG. 3 or other known arrangement for use with a multi-function printed circuit board.

In the illustrated embodiment the connector adapter 17 for making a plurality of electrical connections to the printed circuit board 19 of personal computer 18 comprises four twenty-five pin D-shell connectors 20–23. Of course, other types and numbers of connectors could be used with the adapter. As shown in FIG. 4, a first pair of the connectors 20 and 21 are arranged in side by side relationship with the second pair of connectors 22 and 23 being arranged in side by side relationship above the first pair so that the width w of the housing 24 of the adapter occupies the space of only one expansion slot 25 in the rear panel 26 of the computer 18, that is, the housing is dimensioned so that it does not interfere with access to adjacent expansion slots in the rear panel. The outer, pin receiving faces of the connectors 20–23 extend through appropriately shaped apertures 27 in the housing. Portions of several of the apertures 27 are depicted in the perspective view of the disassembled parts of the housing in FIG. 7. The connectors 20–23 are secured to the housing 24 of the adapter by threaded fasteners 28. The length of the housing 24 is large enough to span the opening 51 in the rear panel 26 in the illustrated embodiment but this need not be the case.

Figure 5:
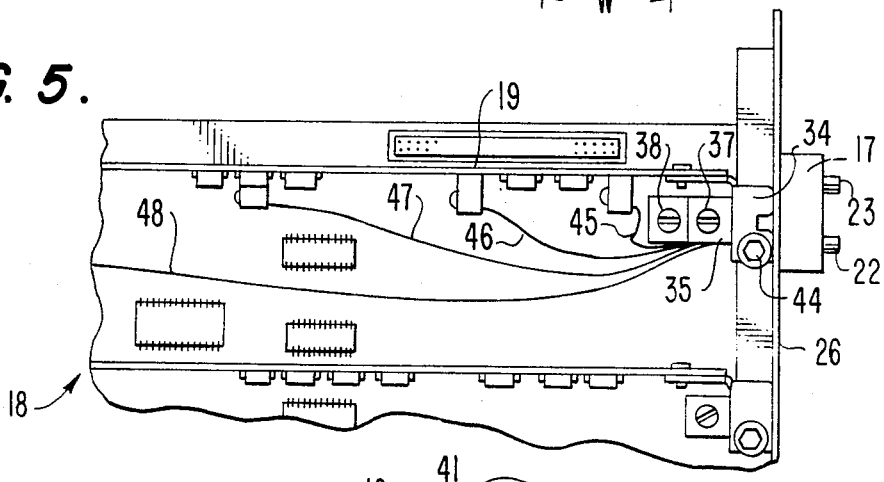
FIG. 5 is a top view of the personal computer of FIG. 4 with the cabinet cover removed and showing the top of the connector adapter of the invention adjacent the rear panel of the computer with ribbon conductor cables extending from the adapter through a slot in a mounting bracket to multiple pin connectors on the printed circuit board.
Figure 6:
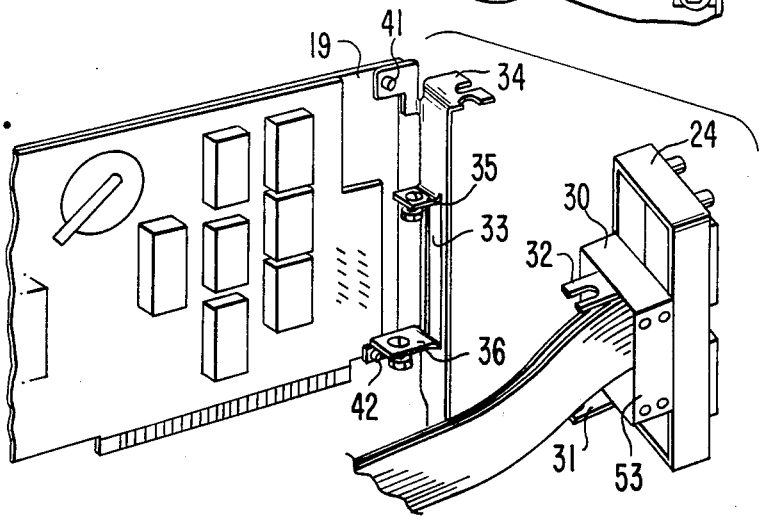
FIG. 6 is a perspective of the connector adapter of the invention with the mounting bracket thereof connected to the printed circuit board but disassembled with respect to the rear panel of the computer cabinet and the adapter housing containing the plurality of multiple pin connectors.
Figure 7:
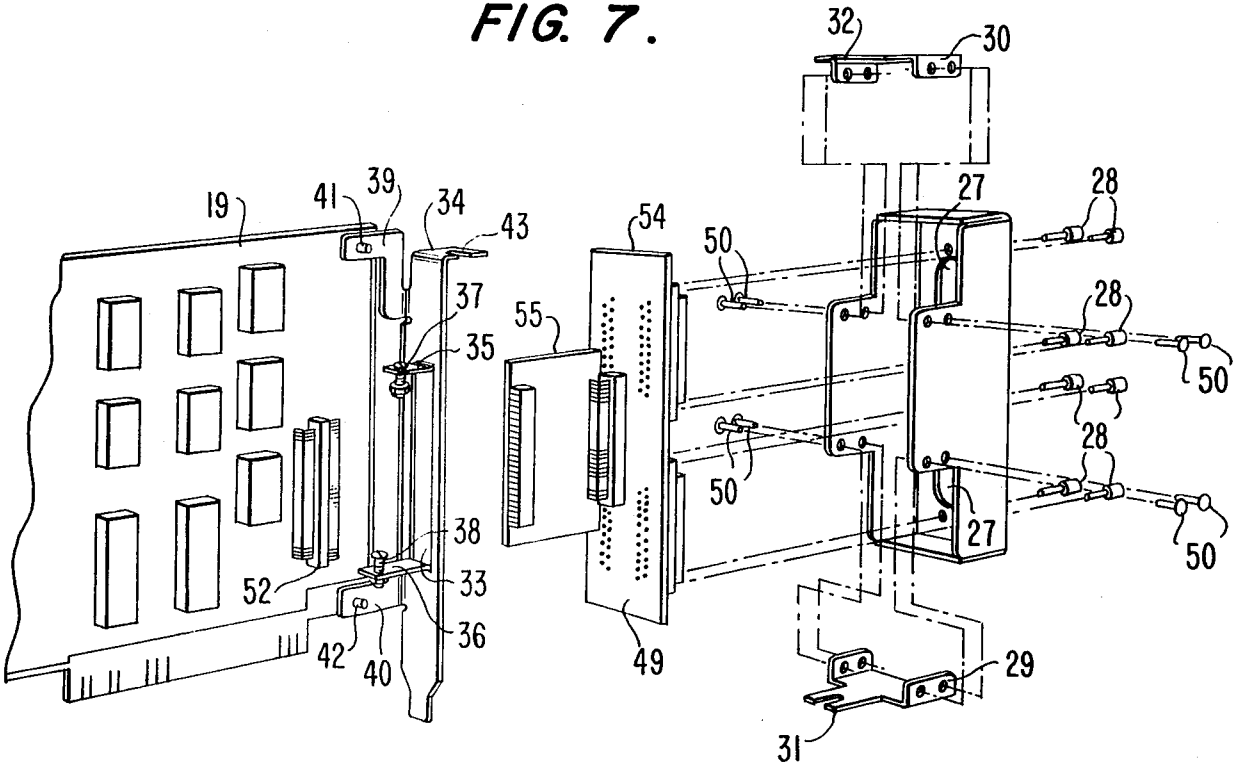
FIG. 7 is a perspective view of the disassembled parts of the connector adapter housing of the invention and illustrating another form of the means for electrically connecting the plurality of the multiple pin connectors of connector adapter to the printed circuit board of the computer.

The housing 24 is preferably formed of sheet metal and includes two mounting members 29 and 30 releasably mechanically connected to the housing with threaded fasteners 50. The mounting members 29 and 30 have respective mounting tabs 31 and 32 formed thereon. The mounting tabs 31 and 32 are adapted to pass through a slot 33 formed in a mounting bracket 34 of the adapter. Flanged portions 35 and 36 of the bracket 34 at the ends of the slot 33 carry releasable fasteners 37 and 38 such as threaded bolts with nuts for releasably mechanically connecting the mounting bracket 34 to the housing 24 of the adapter at the mounting tabs 31 and 32. The fasteners 37 and 38 are horizontally offset with respect to one another as shown in FIGS. 5–7 for easy access. The mounting bracket 34 is directly and releasably mechanically connected to the printed circuit board 19 by means of conventional releasable fasteners 41 and 42 such as machine screws in arms 39 and 40 of the mounting bracket 34. The mounting bracket 34 also includes a retainer screw slot 43 at the top thereof for releasably mechanically connecting the bracket 34 to the rear panel 26 of the computer 18 by means of a screw 44 illustrated in FIG. 5.

The slot 33 in the mounting bracket 34 receives the means for electrically connecting the plurality of multiple pin connectors 20–23 of the connector adapter 17 to the printed circuit board. In the form of the invention illustrated in FIGS. 4–6, the means for electrically connecting the connectors 20–23 to the printed circuit board 19 comprises a plurality of ribbon conductor cables 45–48 for connecting respective ones of the connectors 20–23 to individual input/output connectors of the multi-function board 19. Alternatively, the means for electrically connecting the connectors 20–23 to the board 19 is a connector printed circuit board assembly 49 including a board 54 and a board 55 which connects each of the plurality of connectors 20–23 to a single multi-function board connector 52 on the printed circuit board 19 of the personal computer as depicted in FIG. 7. With this latter arrangement the use of the ribbon conductor cables is unnecessary. The printed circuit board assembly 49 of the connector adapter extends through the slot 33 in the mounting bracket 34 when the connection is made to the connector 52 on the printed circuit board.

From a review of the above, it is seen that the connector adapter of the invention occupies only the space of one expansion slot in the rear panel of the computer so that it does not interfere with the connectors located in adjacent slots. Moreover, because the portion 53 of the housing with mounting members 29 and 30 thereon extends within opening 51 to the rear panel of the computer about a slot 25, the housing of the connector adapter provides full RFI shielding for any ribbon conductor cables or other conductors used to electrically connect the connectors of the adapter to the printed circuit board. Thus, the aforementioned disadvantages associated with the prior art arrangements are avoided by means of the invention which, nevertheless, expands the number of possible connections so that up to four twenty-five D-shell (or other type) connections can be made to the multi-function printed circuit board of the computer. The connector adapter of the invention is mounted directly to the printed circuit board by two captive screws located on the mounting bracket of the connector adapter. Thus, no modification of the computer cabinet is required for accepting the connector adapter of the invention. The mounting bracket is also secured to the rear panel of the computer to hold the board and adapter relative to the computer cabinet. Further, the connector adapter of the invention can be used with other replacement multi-function cards than that shown which require multiple I/O connectors.

While I have shown and described one embodiment in accordance with the present invention, it is understood that the same is not limited thereto, but is susceptible of numerous changes and modifications as would be known to those skilled in the art, given the present disclosure. Thus, I do not wish to be limited to the details shown and described, but intend to cover all such changes and modifications as are encompassed by the scope of the appended claims.

I claim:

1. In a cabinet containing at least one printed circuit board mounted therein and comprising an outer panel having at least one expansion opening therein to permit devices external to the cabinet to be electrically connected to the printed circuit board, the improvement comprising a connector adapter adapted to be added onto said cabinet for making a plurality of electrical connections with the printed circuit board from said external devices, said adapter comprising a housing with a plurality of multiple pin electrical connectors, said housing being adapted to be applied to the outside of said cabinet with a portion of said housing being inserted into said expansion opening of the cabinet, means for electrically connecting said plurality of multiple pin connectors to said printed circuit board, a mounting bracket adapted to be located inside said cabinet, means for releasably mechanically connecting said bracket directly to said printed circuit board and means for releasably mechanically connecting said mounting bracket to said portion of the housing inserted into said expansion opening.

2. A connector adapter according to claim 1, wherein said housing includes at least four multiple pin connectors.

3. A connector adapter according to claim 2, wherein said housing includes a first pair of multiple pin connectors arranged in side by side relationship and a second pair of multiple pin connectors arranged in side by side relationship, the first and second pairs of connectors being positioned one above the other so that the width of said housing occupies only the space of said expansion opening in said outer panel of said cabinet.

4. A connector adapter according to claim 1, wherein said mounting bracket includes a slot formed therein for receiving said means for electrically connecting said plurality of multiple pin connectors to said printed circuit board.

5. A connector adapter according to claim 4, wherein said means for releasably mechanically connecting the mounting bracket to said portion of the housing includes a pair of fasteners located adjacent opposite ends of said slot for receiving mounting tabs which are connected to said portion of the housing and extend through said slot.

6. A connector adapter according to claim 5, wherein said fasteners are offset with respect to one another for easy access.

7. A connector adapter according to claim 1, wherein said means for electrically connecting said plurality of multiple pin connectors to said printed circuit board includes a connector printed circuit board assembly which connects each of said plurality of connectors to a single multiple-function board connector on the printed circuit board of said cabinet.

8. A connector adapter according to claim 1, wherein said means for electrically connecting said plurality of multiple pin connectors to said printed circuit board includes a plurality of ribbon cables connecting respective ones of said plurality of said connectors to respective connectors of said printed circuit board.

9. A connector adapter for making a plurality of electrical connections to a printed circuit board of a computer from peripheral equipment, said adapter comprising a plurality of multiple pin connectors, means for electrically connecting said connectors to said printed circuit board, a housing for said plurality of multiple pin connectors, a mounting bracket for releasably mechanically connecting said adapter to the printed circuit board, said mounting bracket including a slot formed therein for receiving said means for electrically connecting, releasable fastener means being provided adjacent opposite ends of said slot in said bracket, said housing being formed with a pair of mounting tabs which extend through said slot and which are releasably mechanically connected to said mounting bracket by said fastener means to thereby releasably connect said housing and said bracket.

10. A connector adapter adapted to be added onto a personal computer containing a multi-function printed circuit board for making a plurality of electrical connections from external peripherals to the multifunction printed circuit board within the personal computer through a single expansion slot of a plurality of expansion slots located in a rear panel of a cabinet of said computer, said adapter comprising a plurality of multiple pin connectors adapted to be located outside of said computer cabinet, a housing for said plurality of multiple pin connectors, a mounting bracket adapted to be located inside said computer cabinet for releasably mechanically connecting said adapter to the printed circuit board, said mounting bracket including a slot formed therein which is adapted to be in substantial alignment with said expansion slot for receiving means for electrically connecting said connectors to said printed circuit board, a portion of said housing extending through said expansion slot and said mounting bracket slot to said mounting bracket, releasable fastener means connecting said housing to said mounting bracket at said portion extending through said expansion slot and mounting bracket slot, and wherein the dimensions of said housing are so limited that said housing does not interfere with the access to the other expansion slots of said plurality of expansion slots in the rear panel of said computer cabinet.

11. A connector adapter adapted to be added onto a personal computer containing a multi-function printed circuit board for making a plurality of electrical connections from external peripherals to the multifunction printed circuit board within the personal computer through a single expansion slot of a plurality of expansion slots located in a panel of a cabinet of said computer, said adapter comprising a plurality of multiple pin connectors adapted to be located outside of said computer cabinet, a housing for said plurality of multiple pin connectors, said housing with connectors being adapted to be applied to the outside of said cabinet containing said printed circuit board in a position over said single expansion slot, means for supporting said housing directly adjacent said computer cabinet over said single expansion slot and means for electrically connecting said plurality of multiple pin connectors to said printed board, said means for electrically connecting extending from said multiple pin connectors in said housing through said single expansion slot to said printed circuit board and being fully RFI shielded by said housing and said computer cabinet.

12. A method of adding on a connector adapter to a personal computer to permit making a plurality of electrical connections from external peripherals to a multi-function printed circuit board within the personal computer through a single expansion slot of a plurality of expansion slots located in an outer panel of a computer cabinet, said method comprising the steps of providing a connector adapter housing with a plurality of multiple pin connectors, positioning said housing over the outside of an expansion slot of said cabinet including inserting a portion of said housing into said expansion slot and mechanically connecting said connector adapter housing to said printed circuit board by means of a mounting bracket located inside said cabinet, wherein said method also includes providing means for electrically connecting said plurality of multiple pin connectors to said printed circuit board, said means for electrically connecting being fully RFI shielded by said housing and said computer cabinet.

13. A method according to claim 12, wherein the dimensions of said housing are such that when said housing is positioned over said expansion slot it does not interfere with the access to the other expansion slots.

14. A method according to claim 12, wherein said mounting bracket includes a slot therein within which said housing portion is inserted during said positioning step.

* * * * *